US007124988B1

(12) United States Patent
Duffy et al.

(10) Patent No.: US 7,124,988 B1
(45) Date of Patent: Oct. 24, 2006

(54) FOLDING CANTILEVER SUPPORT AND METHOD

(76) Inventors: Leonard Arnold Duffy, P.O. Box 99, Hinesburg, VT (US) 05461; Robert Brennan Duffy, 5048 St George Rd., Williston, VT (US) 05495

( * ) Notice: Subject to any disclaimer, the term of this patent is extended or adjusted under 35 U.S.C. 154(b) by 2 days.

(21) Appl. No.: 10/654,408

(22) Filed: Sep. 3, 2003

Related U.S. Application Data

(60) Provisional application No. 60/409,783, filed on Sep. 11, 2002.

(51) Int. Cl.
*E04G 3/00* (2006.01)
*A47B 19/00* (2006.01)

(52) U.S. Cl. ..... 248/284.1; 248/441.1; 108/40

(58) Field of Classification Search ..... 248/284.1, 248/441.1, 447, 447.1, 447.2, 453, 442.2, 248/465.1, 226.11, 227.2, 231.51; 108/40, 108/97
See application file for complete search history.

(56) References Cited

U.S. PATENT DOCUMENTS

| | | | | | |
|---|---|---|---|---|---|
| 752,234 | A | | 2/1904 | Lawson | |
| 1,197,351 | A | | 9/1916 | Dalglish | |
| 1,223,637 | A | | 4/1917 | Swain | |
| 1,878,864 | A | * | 9/1932 | Lane et al. | 312/140.4 |
| 2,254,832 | A | | 9/1941 | Weight | |
| 2,325,324 | A | | 7/1943 | Kent | |
| 2,346,703 | A | * | 4/1944 | Forhan et al. | 248/453 |
| 2,451,667 | A | | 10/1948 | Ducey | |
| 2,565,719 | A | | 8/1951 | Churcot | |
| 2,771,332 | A | * | 11/1956 | McGinley | 108/46 |
| 2,798,780 | A | * | 7/1957 | Motorney | 297/163 |
| 2,814,154 | A | * | 11/1957 | Krueger | 248/447.1 |
| 3,074,745 | A | * | 1/1963 | Burckhalter | 108/44 |
| 3,099,101 | A | | 7/1963 | Burris | |
| 3,126,226 | A | | 3/1964 | Johnson | |
| 3,133,760 | A | | 5/1964 | Robinson | |
| 3,181,485 | A | | 4/1965 | Dotson et al. | |
| 3,212,742 | A | | 10/1965 | Pavoni | |
| 3,240,463 | A | | 3/1966 | Cook | |
| 3,289,615 | A | | 12/1966 | Marschak | |
| 3,301,406 | A | | 1/1967 | Scott | |
| 3,662,982 | A | * | 5/1972 | Antonius | 248/205.1 |
| 4,032,101 | A | | 6/1977 | Immordino | |
| 4,033,652 | A | | 7/1977 | OBrien | |
| 4,184,725 | A | | 1/1980 | Spangler | |
| 4,239,170 | A | * | 12/1980 | Planebo | 248/447.1 |
| 4,269,381 | A | | 5/1981 | Harms | |
| 4,312,535 | A | | 1/1982 | Smith | |
| 4,369,948 | A | | 1/1983 | Krauss | |
| 4,460,145 | A | | 7/1984 | Ando | |
| 4,506,928 | A | | 3/1985 | Marion | |
| D279,533 | S | | 7/1985 | Gildart | |

(Continued)

FOREIGN PATENT DOCUMENTS

| | | |
|---|---|---|
| CA | 957265 | 11/1974 |

(Continued)

*Primary Examiner*—Anita M. King

(57) ABSTRACT

A portable device and method for supporting a load in a cantilevered disposition relative to a shelf, cabinet, or other extant structure is provided, which device is foldable into a relatively compact entity when not in use. The device includes at least a platform portion 01, a bracing portion 02, and a pivotably attached hanging bracket 03, and can be configured to support such a load in a horizontal or inclined position at a near or relatively distant horizontal or vertical relationship to the extant structure. The device may be independent, attached to, or integrally manufactured with the load.

20 Claims, 5 Drawing Sheets

U.S. PATENT DOCUMENTS

| | | | | | |
|---|---|---|---|---|---|
| 4,568,120 | A | | 2/1986 | Hoffman | |
| 4,846,432 | A | | 7/1989 | Skewis | |
| 4,901,969 | A | | 2/1990 | Yaeger | |
| 5,036,777 | A | | 8/1991 | Barton | |
| 5,317,977 | A | | 6/1994 | Omessi | |
| 5,342,006 | A | | 8/1994 | Tice | |
| 5,549,054 | A | | 8/1996 | Lewis | |
| 5,590,607 | A | | 1/1997 | Howard | |
| 5,609,318 | A | | 3/1997 | Scheh | |
| 5,829,787 | A | * | 11/1998 | Newhouse, Jr. | 281/46 |
| 5,836,562 | A | | 11/1998 | Danzyger | |
| 5,941,490 | A | | 8/1999 | Pearse | |
| 6,038,983 | A | * | 3/2000 | Lendl | 108/44 |
| 6,045,159 | A | * | 4/2000 | Bellah | 281/29 |
| 6,092,774 | A | | 7/2000 | Choy | |
| 6,142,140 | A | | 11/2000 | Shumaker | |
| 6,152,416 | A | | 11/2000 | Jacob | |
| 6,202,966 | B1 | | 3/2001 | MacDonald | |
| 6,276,646 | B1 | | 8/2001 | Gaba | |
| 6,338,302 | B1 | | 1/2002 | Montagner | |
| 6,357,703 | B1 | | 3/2002 | DiOrio | |
| 6,435,634 | B1 | * | 8/2002 | Webb et al. | 312/313 |
| 6,439,534 | B1 | | 8/2002 | Hensel | |
| D474,652 | S | | 5/2003 | Chan | |
| 6,619,609 | B1 | * | 9/2003 | Cress | 248/447 |

FOREIGN PATENT DOCUMENTS

| | | |
|---|---|---|
| CH | 249 100 | 3/1948 |
| CH | 281 700 | 3/1952 |
| DO | 631 297 | 5/1956 |
| DO | 1052650 | 3/1959 |
| FR | 940 114 | 4/1948 |
| FR | 1242268 | 8/1960 |
| GB | 2113 540 | 8/1983 |
| WO | WO 99/27816 | 6/1999 |

* cited by examiner

FOLDING CANTILEVER SUPPORT AND METHOD

CROSS-REFERENCE TO RELATED APPLICATIONS

This application claims priority based on Provisional U.S. Patent Application No. 60/409,783 filed Sep. 11, 2002.

FEDERALLY SPONSORED RESEARCH

Not applicable

SEQUENCE LISTING OR PROGRAM

Not applicable

BACKGROUND

1. Field of Invention

This invention is related to cantilevered supports, particularly to such supports which can be readily attached to or removed from an extant horizontal structure.

2. Prior Art

Although various devices exist to support a cantilevered load as an extension to a shelf, table, or other extant structure, most such devices generally include some type of mechanical fastener or clamping mechanism and others appear to be limited in functionality. Devices with permanent or semi-permanent connection to the extant structure by means of screws, rivets, or mechanical tightening devices are exemplified by Weight U.S. Pat. No. 2,254,832. Devices which incorporate some type of clamping device: are exemplified by Howard U.S. Pat. No. 5,590,607 and Prioux FR 1,242,268. O'Brien U.S. Pat. No. 4,033,652 exemplifies cantilever devices designed for specific receptors. Cantilevered extensions from a vertical surface with a top edge or vertical stop are exemplified by Harms U.S. Pat. No. 4,269,381 and Shumaker U.S. Pat. No. 6,142,140. Book holders for permanent under shelf mounting are disclosed by Krauss U.S. Pat. No. 4,369,948 and Nickerson U.S. Pat. No. 6,227,385B1. Pendulum type hangers are exemplified by Pearse U.S. Pat. No. 5,941,490. Table mounted baby seats are disclosed by Ducey U.S. Pat. No. 2,451,667, Robinson U.S. Pat. No. 3,133,760, Smith U.S. Pat. No. 4,312,535, Marion U.S. Pat. No. 4,506,928, Hoffman U.S. Pat. No. 4,568,120, Johnson U.S. Pat. No. 3,126,226, and Harley CA 957,265, most including some type of clamp. Hensel U.S. Pat. No. 6,439,534 B1 discloses a recipe card holder for a residential kitchen which appears to be held in place by a closed cabinet door. Harms U.S. Pat. No. 4,269,381 provides a cookbook support restrained by a vertical cabinet member.

The most relevant prior art includes devices having a cantilevered platform supported by a frame designed to fit over the edge of an extant structure and to distribute the resultant forces at a location near the edge of the top extant surface and at a location on the bottom of the extant shelf farther removed from the edge. For instance, 1904 U.S. Pat. No. 752,234 by Lawson, teaches a "Reference Book Shelf Desk" of such a design. While this device may appear to have certain similarities to the present invention it distinctly differs in critical respects. Lawson provides a rigid frame with notch-like openings which are relatively narrow in vertical dimension, therefore his device is limited in that it can not be compactly folded when not in use, nor can it be fitted over a variety of differing edge conditions or shelf thicknesses. In addition, Lawson's device, if mounted on a cabinet with doors, would prevent such doors from closing because the platform and structure extends above the top surface level of the extant shelf. Dotson U.S. Pat. No. 3,181,485, Scott U.S. Pat. No. 3,101,406, Barton U.S. Pat. No. 5,036,777, Tice U.S. Pat. No. 5,342,006, Montagner U.S. Pat. No. 6,338,302, Ducey U.S. Pat. No. 2,451,667, Pavoni U.S. Pat. No. 3,212,747, Scheh U.S. Pat. No. 5,609,318, Gaba U.S. Pat. No. 6,276,646B1, and Borgh WO 99/27816 each teach related devices having a rigid frame with similar limitations. Omessi U.S. Pat. No. 5,317,977 teaches a cantilevered tray device having a multi-part hanging bracket in order to afford limited adjustability relative to shelf thickness but which does not appear to fold or store compactly. Skewis U.S. Pat. No. 4,846,432 teaches a cantilevered tray with a complex multi-directionally folding frame having hanging portions which appear to be connected to the frame via a vertical hinge-like mechanism. However, Skewis's device appears to be relatively cumbersome to unfold and the hanging portions are of a shape which would appear to interfere with a cabinet door if the device were mounted in such a condition. Furthermore, Skewis's device also appears to be designed for a predetermined shelf thickness and to not be adaptable to variable thickness conditions or angular configuration, in that the hanging portions are effectively rigidly connected to the frame when the device is unfolded.

Thus it can be seen that, despite a considerable amount of prior art in the field, none addresses the objects of the present invention as presented below. The need for a simple, easy to use cantilever support device which can fold compactly when not in use, accommodate diverse shelf thicknesses and edge conditions, allow for closure of an overlapping door, provide support at an extended distance before and/or below an extant structure, and provide the other advantages of the present invention as can be seen throughout this document is apparent.

OBJECTS AND ADVANTAGES

Accordingly, objects and advantages of the present invention include the following:

1.) The primary object of the present invention is to provide a means for supporting a load in a cantilevered disposition relative to an extant horizontal structure with a simple, compactly folding portable device which is not dependent on fasteners, clamps, or restraining structure.

2.) Another objective of this invention is to support a book or other document in an inclined position from a shelf, desk, table or cabinet, thereby making it easy to read and isolated from spills, while also saving useable space below.

3.) Another object is to provide a portable means for displaying graphic materials, products, brochures, samples and the like.

4.) Another object is to provide a simple portable support for a keyboard, computer "mouse", display device, or reference materials in relation to a personal computer.

5.) Another object is to provide a temporary shelf extension or enclosure for supporting materials such as ingredients in a kitchen, parts in an industrial environment, office supplies, or retail products.

6.) Another object is to provide a compactly folding support for a portable tool, such as a "laptop" computer or other device, for cantilevering such a device from a table, shelf, desk, or similar structure which can be compactly stored, and which can be permanently or temporarily attached to, or integrally manufactured as part of, the primary device.

7.) Another object is to provide a display easel which includes attached or integrally printed graphic materials.

8.) Another object is to provide a means for any such devices to be suspended from a cabinet with overlapping doors without preventing such doors from closing.

9.) Yet another object is to provide temporary support for a wide range of useful purposes too numerous to mention.

10.) Additional objectives are to enhance the function of the invention for specific uses such as those noted above with particular useful features.

It should be especially noted that the inclusion of a pivotably or hingedly attached hanging bracket offers particular advantages in contrast with prior art. In the first instance, such a hinged bracket allows components of the subject device to be folded relatively flat when not in use so that they can be compactly stored. Such a hinged bracket also allows the device to effectively self-center itself when it is mounted on an extant structure thereby balancing the load. The hinged bracket also allows the device to accommodate various edge conditions and shelf thicknesses without compromising structural integrity by causing moment reactions within the bracket structure. Such a bracket attachment allows the vertical load component of the cantilevered device to be supported purely in tension, thereby allowing a relatively thin material to be used, preferably a thin metal rod, formed sheet metal, extruded metal, or plastic so that an overlapping door can close within normal cabinet tolerances. With the load so supported in relatively vertical tension, friction on the bracket's bearing surface is maximized, thereby minimizing potential slippage.

In each of the preferred embodiments, the advantages of the subject invention include at least the following aspects. A portable device is provided for temporary use that does not require any kind of permanent or semi-permanent attachment or clamping means so that it can readily be mounted, moved or removed without tools or undue mechanical manipulation. A portable device is provided that can be folded relatively flat for storage when not in use; A device is provided that will function effectively with the diverse edge or thickness conditions which may be encountered on an extant structure. A device is provided that will allow closure of an overlapping door against the an extant edge. And, a device is provided that can be adopted for a wide variety of applications.

The embodiment shown in FIG. 1 has the additional advantages of: Providing an inclined surface for supporting a document in a readily readable position; providing a mechanism for retaining a specific page of a document in an open position and also a mechanism for retaining one or more additional pages for reference; and providing a device which can be simply manufactured in diverse designs. The embodiment of FIG. 2 has the additional advantages of providing a relatively horizontal cantilevered platform which can be mounted on horizontal structures of varying thickness, can be angularly adjusted, and which can be designed with particular features such as surface texture or edge padding to provide for specific applications. The embodiment illustrated in FIG. 3 has the additional advantages of compact storage, horizontal containment of items in an enclosed or bin-like container, support provided at a relative vertical distance form the extant structure, and adjustability for varying shelf thicknesses. The embodiment of FIG. 4 has the additional advantages of providing a compactly folding device which presents a horizontal platform at a horizontally and/or vertically extended position relative to the extant structure, and of being attachable to the intended load or integrally manufacturability therewith. The features of each embodiment as illustrated can generally be combined into diverse other combinations.

DRAWINGS

FIG. 1 illustrates in perspective view a first preferred embodiment of the subject invention designed to support a book, graphic material, or document in a cantilevered easel-like disposition relative to an extant structure. FIG. 1A illustrates a sectional view showing various aspects and details of this embodiment. FIGS. 1B–D illustrate optional hinges.

SUMMARY OF THE INVENTION

The present invention provides a method of supporting a load in a cantilevered position relative to an existing horizontal structure such as a shelf, cabinet, table or desk by utilizing a simple portable device which can be folded compactly when not in use. The subject device includes a platform portion which is suspended in a cantilevered position by a pivotably attached bracket mounted on an edge of the extant structure and by a bracing portion engaging with the bottom surface of the extant structure at an area more remote from the edge. The device is mounted to the extant structure by extending the pivotably attached hanging bracket over the extant edge, then vertically rotating the platform and bracing portions until the bracing portion engages the extant bottom surface. The device is thence supported by gravity without attachment means. Embodiments are designed to provide a horizontal platform or an angular easel-like platform and include diverse enhancement features.

Figure 1:
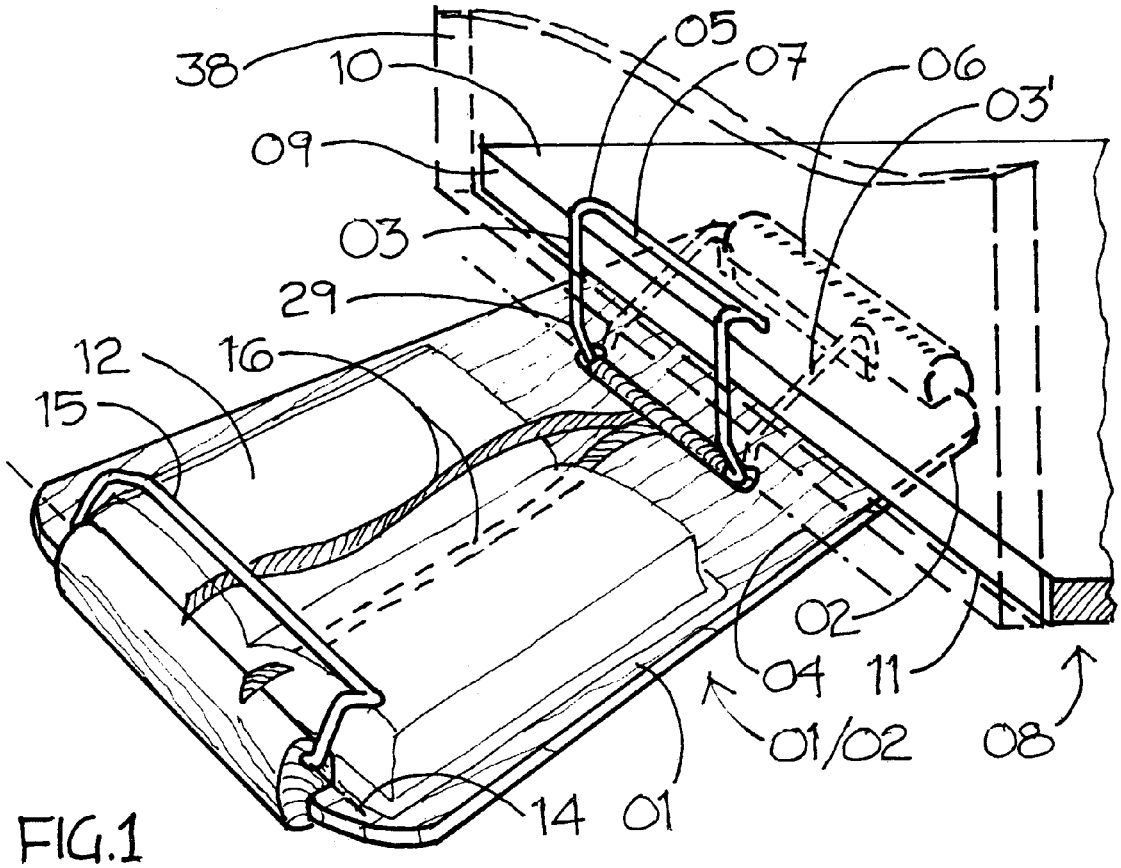
Figure 2:
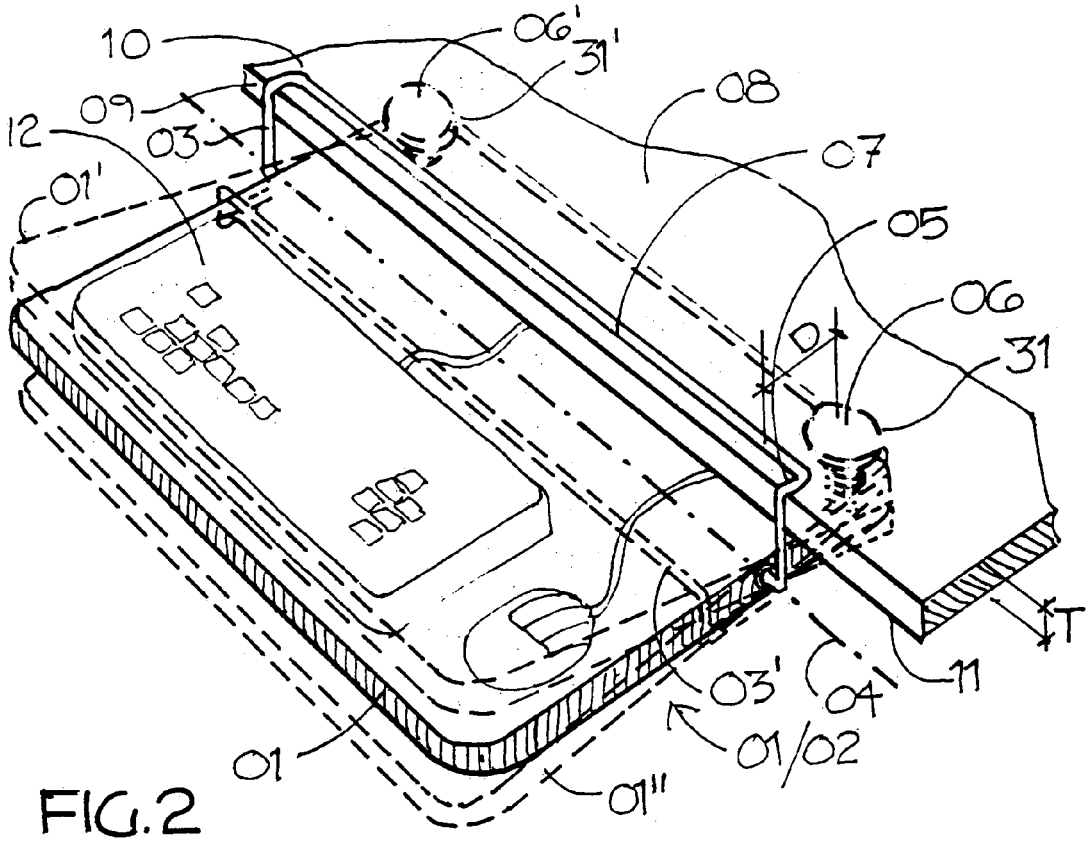
FIG. 2 illustrates in perspective view a second preferred embodiment designed to provide a generally horizontal work surface which may be angularly adjusted.
Figure 2A:
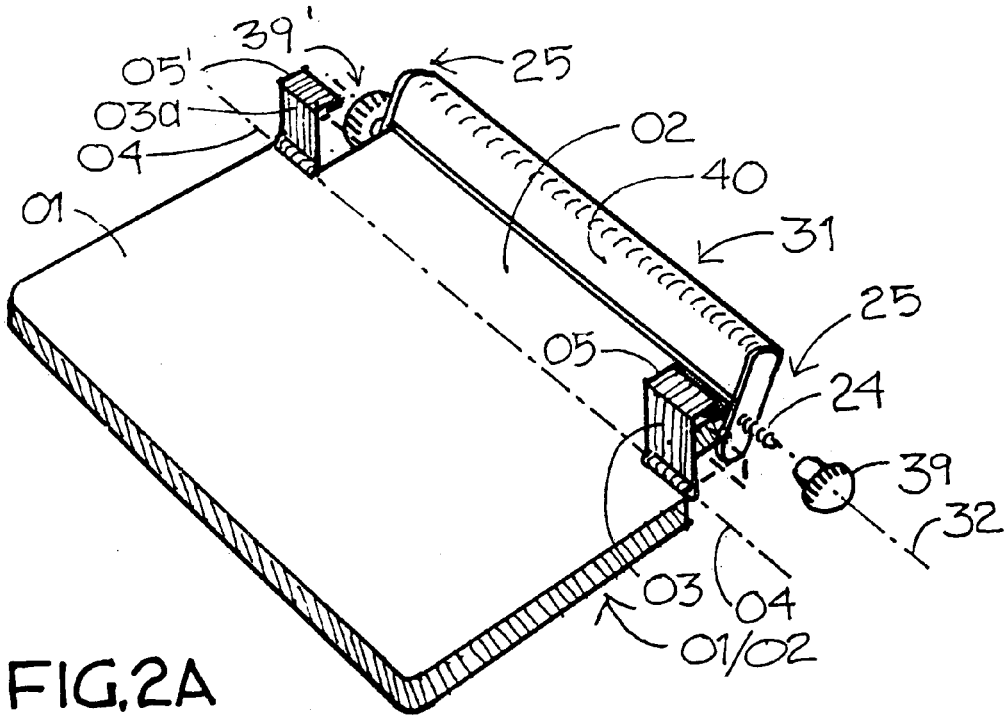
FIG. 2A illustrates a similar embodiment with alternative features.
Figure 3:
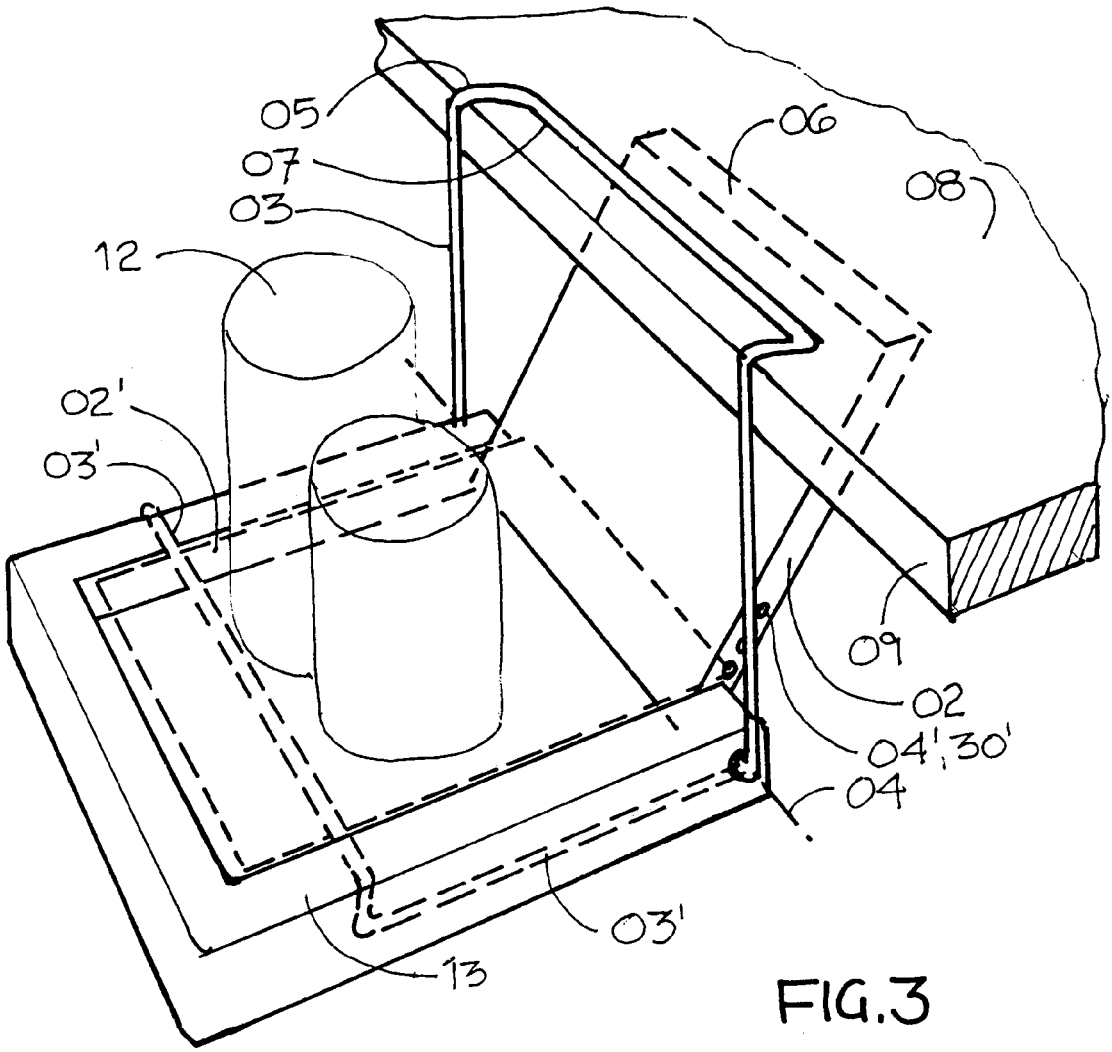
FIG. 3 illustrates in perspective a third preferred embodiment designed to provide a laterally enclosed platform at an extended distance below an extant structure.
Figure 3A:
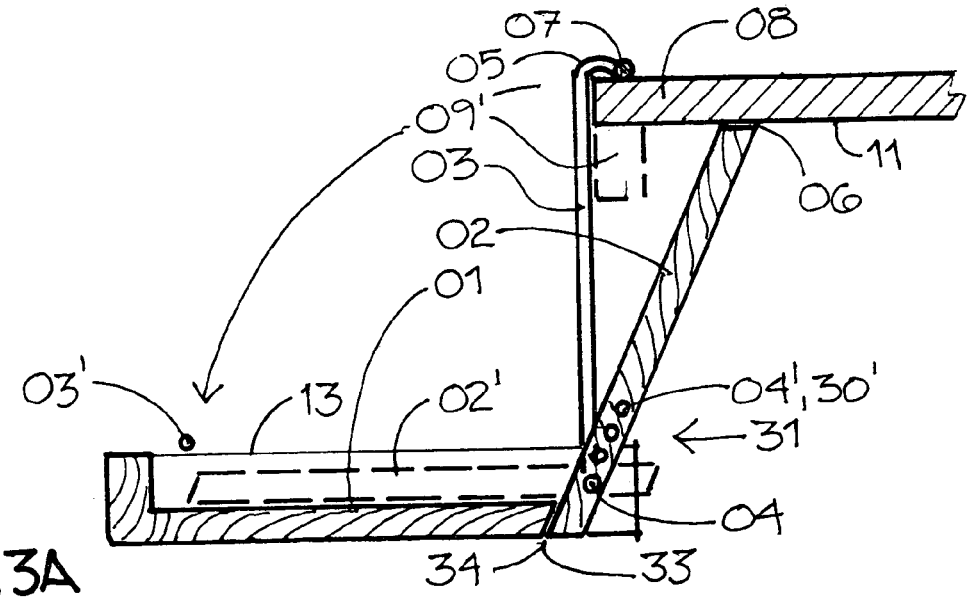
FIG. 3A illustrates this embodiment in cross section.
Figure 4:
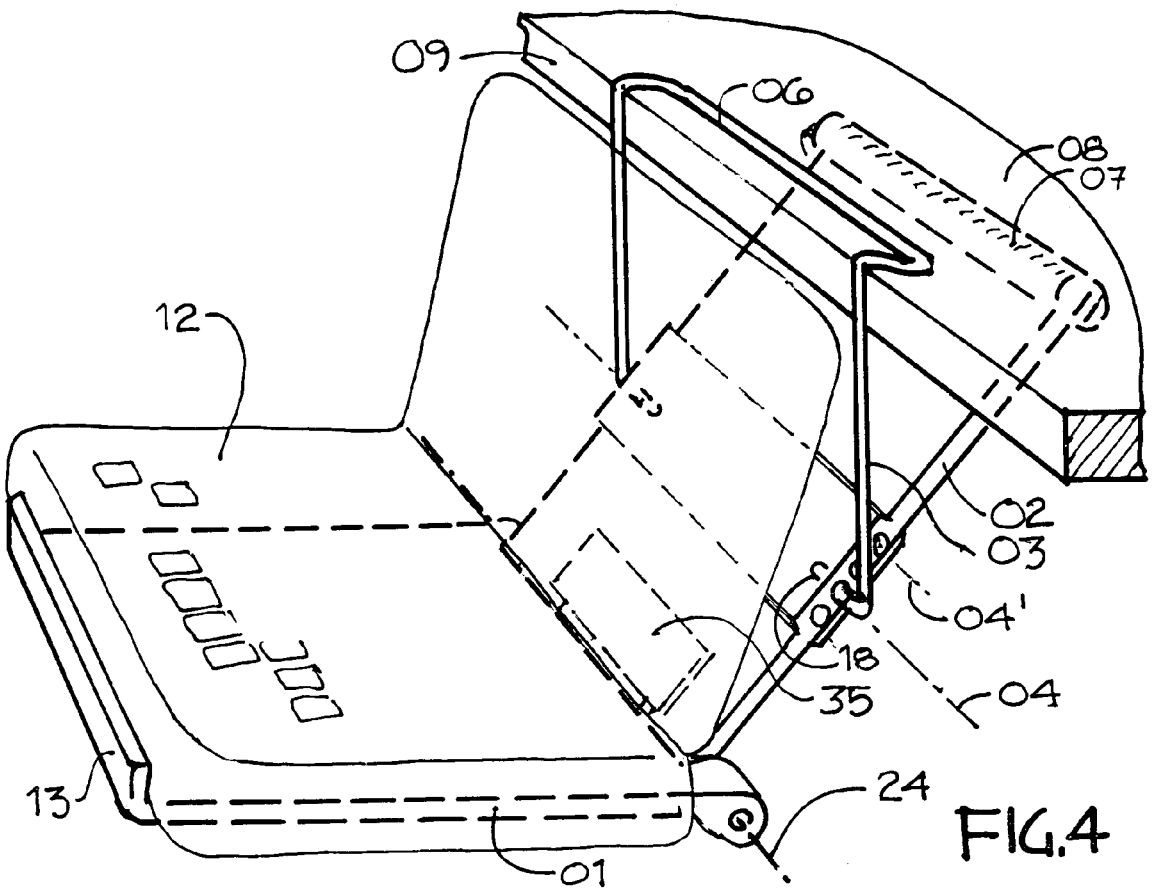
FIG. 4 illustrates in perspective a fourth preferred embodiment designed to provide a platform at an extended distance below and before an extant structure.
Figure 4A:
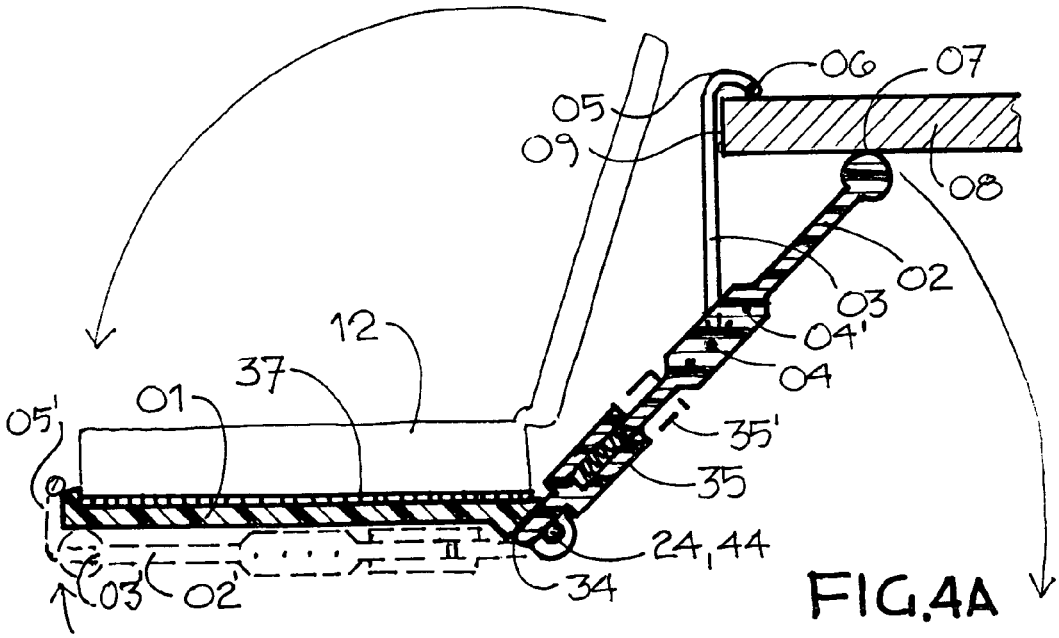
FIG. 4A provides a cross sectional view illustrating details.

As can be seen in the preferred embodiment of FIG. 1, the device can provide an angular easel-like support as is particularly useful for supporting documents or graphics in a readily readable position. In FIG. 2 the platform portion may provide an extended work surface as for a computer or musical keyboard or to provide a generally horizontal surface for documents, writing, drawing, displays, etc. As can be seen in FIG. 2A, a slope can also be provided as is sometimes recommended as an optimal ergonomic position for keyboarding or similar tasks. In FIG. 3, a laterally enclosed support structure is provided which can be used for such purposes as holding ingredients in a kitchen, parts in an industrial setting, office supplies, or items for retail sales or promotion. By attaching the components at a common axis, the compactly folding device of FIG. 3 is able to support its load at a relative distance below the level of the extant structure. In the embodiment of FIG. 4, a generally horizontal platform portion is provided which is effectively extended a relatively farther distance both before and below the extant structure so as to allow, for example, a portable computer screen to be angularly adjusted without interference. FIG. 4 also illustrates how the subject device may be permanently or semi-permanently attached to, or integrally manufactured with a tool or other item such as the portable computer of the example. An embodiment of the latter type can be particularly useful for students or others at a seminar table situation, for providing a work platform and knee space adjacent to a narrow shelf, or for working next to a desktop. As noted above, such an embodiment may also be provided with angular adjustability for ergonomic or other purposes.

DESCRIPTION

All embodiments of the subject invention include a method for supporting a load 12 in a cantilevered disposition relative to an extant horizontal structure 08, such as a shelf, table, desk, or similar structure, by utilizing a portable device stabilized by gravity that does not require semi-permanent or permanent attachment means. The device includes at least a platform portion 01, a bracing portion 02, and a hanging bracket 03 which is pivotably attached at horizontal axis 04. The subject method includes extending the pivoted hanging bracket 03 over the edge 09 of extant horizontal structure 08, and then vertically rotating the device so that load 12 acting by gravity on platform portion 01 is supported vertically by the pivoted hanging bracket 03, and the moment couple resulting from the cantilevered load is offset by bracing portion 02.

Figure 1A:
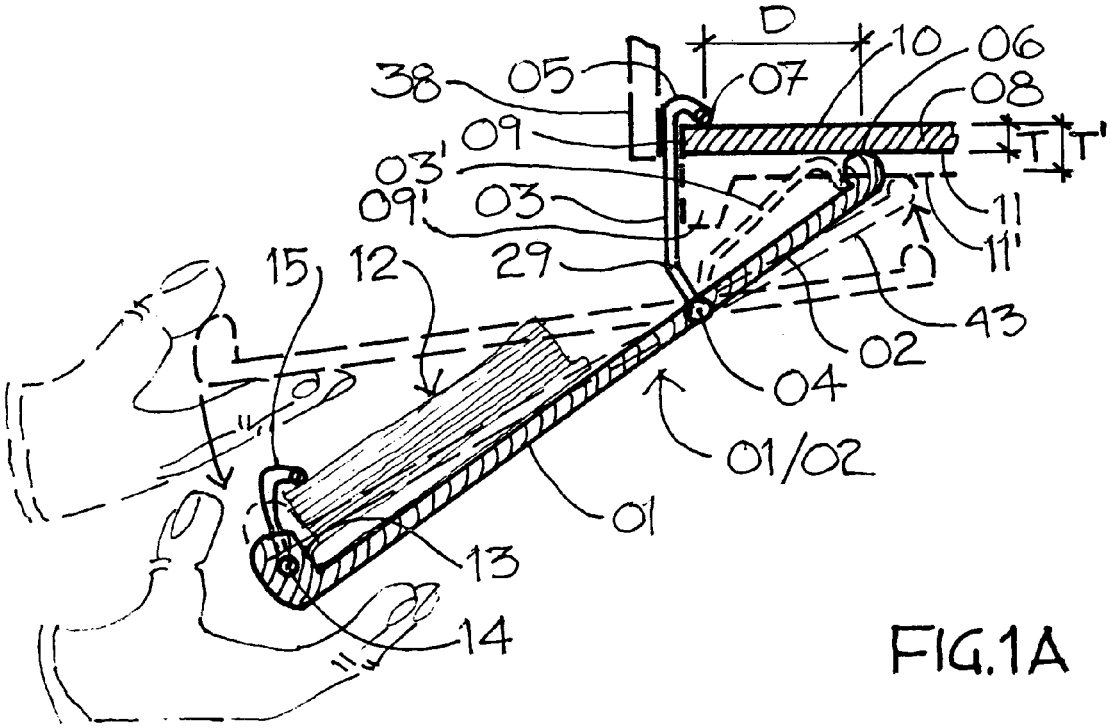

In the first preferred embodiment illustrated in FIGS. 1–1A, platform portion 01 is supported in a generally sloped disposition relative to extant structure 08 so as to provide an easel-like support for a book, magazine, recipe card, display, other such document or other load 12 which can be temporarily suspended from an extant horizontal structure 08 such as a table or cabinet shelf without the use of fasteners, clamps or other type of fixed connection. In this embodiment, platform portion 01 is structurally integral with bracing portion 02, thereby forming an effectively rigid common platform/bracing structure 01/02, and hanging bracket 03 is pivotably attached to the platform and bracing portions at horizontal axis 04 which is generally parallel to extant edge 09. It can be seen that hinge axis 04 effectively distinguishes platform portion 01 from bracing portion 02 and that hanging bracket 03, rotating about pivot axis 04, may be folded 03' toward common platform/bracing structure 01/02 so as to provide a relatively compact entity when the device is not in use. It can also be seen that the pivotably attached hanging bracket 03 includes an end segment 05 at its distal end which is configured in a "J", "L" or hook-like relationship to the bracket's generally vertical disposition when in use so as to locate the vertical load component of the subject device at bearing segment 07 acting at a predetermined area generally adjacent to but not coincident with edge 09.

The device may be utilized by first unfolding hanging bracket 03 by extending end segment 05 away from common structure 01/02 in a generally perpendicular position, then rotating the assembly about a generally horizontal axis parallel to edge 09 so that bearing segment 07 of bracket 03 is mounted on the upper surface 10 of extant structure 08 adjacent to edge 09 and bearing segment 06 of bracing portion 02 engages with an area of bottom surface 11 of extant structure 08 at a location farther removed from edge 09 in a direction generally opposite platform portion 01. Such a sequence of providing support is schematically illustrated in FIG. 1A It can be seen that the device and applied load 12 is supported in its cantilevered disposition by offsetting the resultant moment couple at bearing segments 07 and 06. Alternatively of course, the bracing portion 02 may be generally engaged prior to mounting hanging bracket 03. It should be noted that horizontal dimension "D" measured between bearing points 06 and 07 in a direction generally perpendicular to edge 09 should at least be greater than thickness "T" of the extant structure in order to effectively resist the resultant moment couple, and that a somewhat larger dimension is generally desirable in order to provide adequate stability and adaptability to variable thicknesses T, T' of diverse extant structures.

It is important to understand that the pivotably attached hanging bracket 03 tends to align itself in a generally vertical orientation as the device is mounted in place and load 12 is applied, thereby attaining an effectively self-balancing position. Because the pivoting connection prevents the transfer of moment stresses from platform 01 or brace 02 to hanging bracket 03, the vertical portion of such bracket 03 is effectively stressed in tension only, thereby allowing any relatively thin material of reasonably adequate tensile strength to be utilized for such bracket. Such a bracket 03, formed of wire or metal rod, extruded metal, formed sheet metal, molded plastic or other relatively thin material allows the device to be mounted, for instance, on the bottom shelf of a cabinet having an overlapping door 38 without interfering with the closure of such a door within normal fabrication tolerances. Furthermore, the hinged connection allows the device to be mounted on a variety of extant structures having diverse edge conditions 09', such as decorative edge moldings or structural members, or having diverse thicknesses T, T': Such thickness differentials being compensated by a slight variation in platform angle as seen in FIG. 1A whilst the hanging bracket 03 retains its generally vertical orientation and structural integrity. It is to be appreciated that this pivoted connection provides distinct advantages in comparison to a rigid connection of bracket to structure as in prior art which tend to impart a horizontal force component if such a prior art device were varied in pitch. In each embodiment, in an instance where the extant structure 08 may include a decorative edge molding or structural support 09' extending below its edge 09, the device can generally be sized to accommodate such an additional edge "molding", but it does not depend on such an edge condition to maintain its structural integrity. In an instance where the extant structure 08 includes an overlapping door 38 the relatively thin profile, as discussed above, of hanging bracket 03 allows the door 38 to be effectively closed after bracket 03 has been mounted, but the device is not dependent on such closed door to function. Therefore the device may be usefully employed in a wide range of conditions, including mounting on the lower shelf of a closed cabinet. In any embodiment, it is generally desirable to enhance friction on bearing surface 07 by utilizing a surface treatment or coating.

The embodiment of FIG. 1 also includes several optional features intended to enhance its function. An optional lateral restraining member or rail 13 is provided at the edge of platform portion 01 in order to prevent load 12, which could be a book or other item, from sliding off of the sloped platform. An optional hold-down bracket 15 is also provided as a mechanism for retaining such a book or other document in an open disposition. Such a hold-down bracket 15 may be rigidly attached, structurally integral with rail 12, spring connected, or hingedly attached at a hold-down bracket axis 14. One or more flexible page markers 16 may also be optionally included as part of the overall assembly. Alternatively, an easel-like embodiment as in FIG. 1 can be provided with a wide range of other enhancements. For instance: a simple flat surface without rail 13 can be provided as an integral graphic display; a clipboard-type clamp or other such device can be mounted on the platform portion 01 to hold or display materials; a hinged or rigid protective cover can be provided over the platform; other types of hold-down or page marking means may be provided; diverse surfaces including perforations, corrugations, slots, etc. may be provided; or other features provided for particular applications.

Figure 1B:
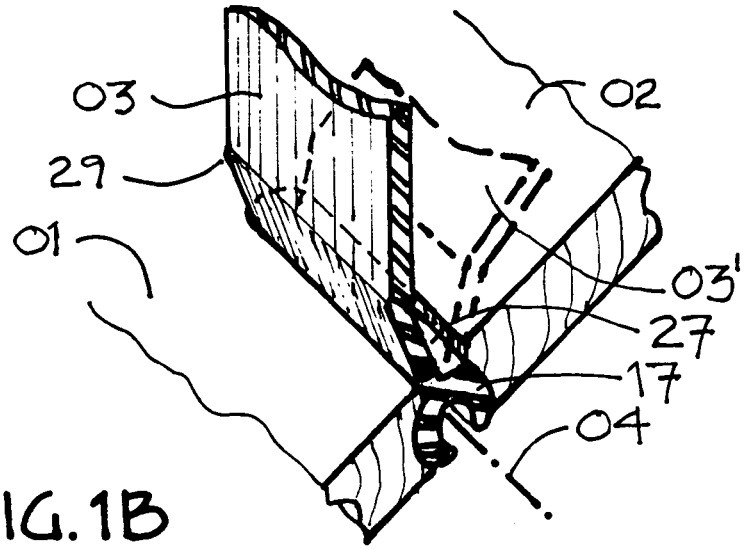
Figure 1C:
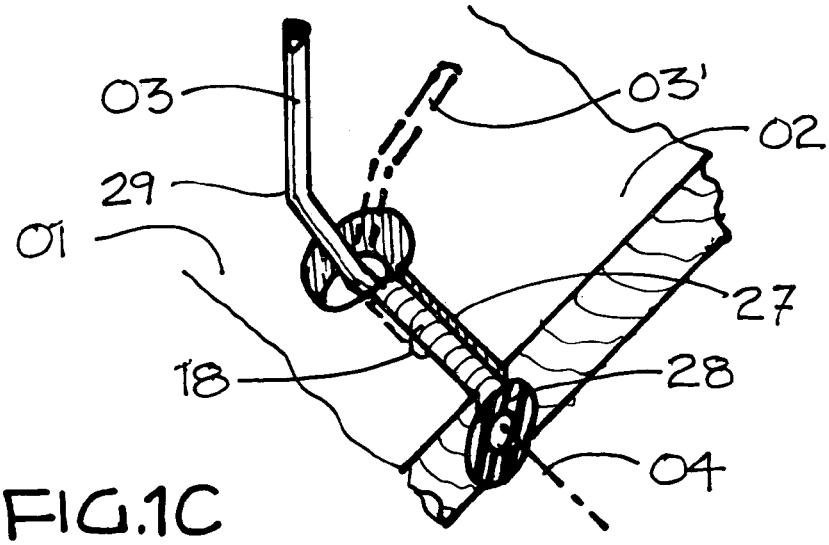
Figure 1D:
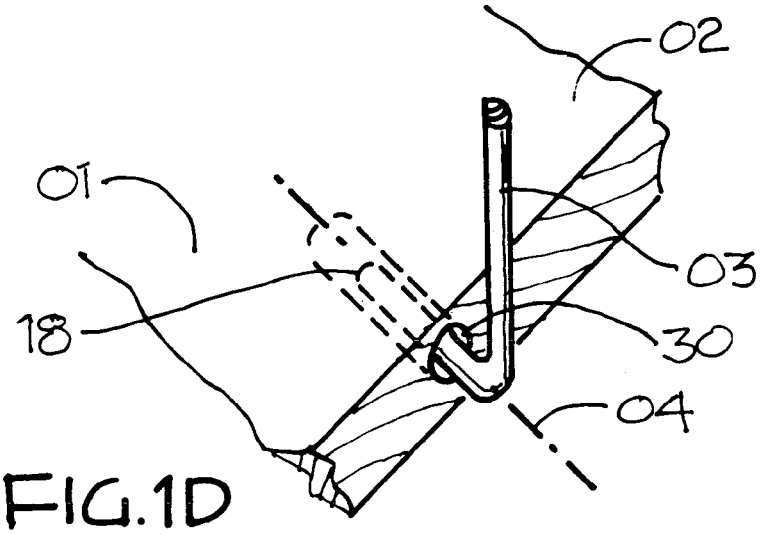

The pivotal attachment of hanging bracket 03 at axis 04 may be provided by any common type of hinging means known to industry for such uses. Several optional hinge configurations are shown in FIGS. 1B, 1C and 1D as examples of the many possibilities within the scope of the invention. In FIG. 1B, a slot 27 is provided along axis 04 through the common support/bracing structure 01/02; and hanging bracket 03, shown here as an extruded metal section, is provided as a generally planar structure with a generally bulbous profile at its pivoting end 17 designed to correspond with slot 27 so that such bulbous edge 17 is generally contained within slot 27 but is free to rotate within a predetermined radial range. In FIG. 1C, a similar slot 27 is provided, and hanging bracket 03 is a rigid rod or wire-like structure having ends 18 aligning with axis 04 which are contained within a generally tubular bearing insert 28 within such slot. Slot 27 may be widened in a perpendicular dimension at each end in order to accommodate rotation of bracket 03. In both instances it should be noted that hanging bracket 03 includes an offset "knee" segment 29 designed to allow bracket 03 to fold relatively flat 03' in relation to the platform/bracing structure 01/02. Also, in both instances, slot 27 has a cross sectional profile designed to contain bulbous profile 17 or bearing insert 28. A third type of hinge is illustrated in FIG. 1D, wherein a hanging bracket 03 of a formed rod or wire type includes ends 18 aligned with axis 04, which ends 18 correspond with and are contained within axial receptors 30 on the lateral edges of the platform/bracing structure 01/02.

A second preferred embodiment illustrated in FIG. 2 is intended to support a cantilevered load in a generally horizontal position from an extant structure such as a shelf or cabinet. Platform portion 01 is structurally contiguous with bracing portion 02, and hanging bracket 03 is hingedly attached at axis 04 as in the previous embodiment. In this instance however, bracing portion 02 includes an adjusting mechanism 31 for adjusting the angular disposition of contiguous structure 01/02 relative to extant horizontal structure 08. It should be noted that although the adjusting mechanism 31 is illustrated here as a pair of threaded studs with a bearing segment 06 at their distal ends, this mechanism is intended only for the purpose of varying the distance between structure 01/02 and extant bottom surface 11 and is not intended to function as a clamp. It can be appreciated that because distance D is greater than thickness T, even with such an adjusting mechanism fully extended the assembly effectively hangs loosely from the extant structure and can be readily removed by simply lifting the distal end 05 of platform portion 01 and pivoting it away from edge 09. It should also be noted that adjusting mechanism 31 allows platform portion 01 to be configured in variable angular relationship with extant structure 08, as may be desired to, for instance, support a keyboard device 01' or reading matter 01"in an ergonomically optimal position as illustrated. Numerous other means for providing such an adjustment are known to industry and may be applied to any embodiment within the scope of this invention.

FIG. 2A illustrates an optional alternative design with features applicable to any embodiment of the invention in which hanging bracket 03 comprises two distinct elements 03, 03*a* each pivotably attached in alignment with common axis 04, and which may be optionally fixed to a common axle rotating on such axis. FIG. 2A also illustrates an alternative adjusting mechanism 31 comprising a longitudinal end segment 40 which is hingedly attached at a distinct axis 32 of bracing structure 02, effectively appending end segment 40 to such bracing structure, and including a stop mechanism 25 for temporarily fixing the angular relationship between these elements so as to adjustably accommodate differing thicknesses T or differing desired angular relationships. The stop mechanism 25 is illustrated as a tightening knob 39 at each end of a threaded axle 24 thereby causing a frictional fit when tightened, but it is to be understood that such a stop mechanism could be provided by numerous other means known to industry.

The preferred embodiment illustrated in FIG. 3 includes platform portion 01, bracing portion 02, and hanging bracket 03 each pivotably connected at a common axis 04. This type of embodiment is designed to allow bracing and bracket elements 02, 03 to be folded relatively flat 02', 03' in relation to platform 01 for compact storage. Also, because bracing portion 02 may be configured at an angular relationship to platform portion 01, embodiments of this type are able to support a load on platform portion 01 at a location relatively distant in vertical dimension below the top surface 10 of extant structure 08, thereby allowing such a relatively compact device to support an effectively vertical (tall) load 12 below a level which could interfere with the function of the extant structure. For instance: cooking ingredients can be supported below a kitchen cabinet without interfering with the swing of door 38 of such cabinet; parts or tools can be supported in a useable location below the level of a work surface; or a work surface can be provided at a convenient level below a relatively high extant structure. When the device is extended for use in its unfolded position, surface segment 33 of bracing portion 02 engages with edge 34 of platform portion 01, providing a first mechanism for maintaining a predetermined angular disposition of the bracing structure 02 relative to both platform 01 and bottom surface 11 of extant structure 08.

Bracing portion 02 also includes an optional adjusting mechanism 31, here comprising one or more alternative hinge axes 04' which may be utilized to accommodate extant structures 08 of diverse thickness or to adjust the angular disposition of platform portion 01 by resetting the distal ends 18 of bracket 03 into alternative receptors 30' at alternative axis 04'. It should be noted that the embodiment illustrated in FIG. 3 also includes an optional continuous lateral constraint 13 so as to horizontally contain load 12 in a bin-like confinement. Such means for containment can be applied to any embodiment of the device, can also include means for vertical confinement as in a removable or hinged lid, and can be varied as to relative height, thickness, material, or other aspect within the scope of this invention. Likewise, other aspects of this embodiment may be combined with aspects of other embodiments so as, for example, to combine the easel-like platform portion 01 of FIG. 1 with an independently pivoted bracing portion as in FIG. 3.

FIG. 4 illustrates a fourth preferred embodiment of the subject invention wherein hanging bracket 03 is pivotably connected to bracing portion 02 at a first axis 04 and platform portion 01 is pivotably connected to bracing portion 02 at a distinct second axis 24 generally parallel to first axis 04. The device of this embodiment may include a mechanism similar to that illustrated in FIG. 3, wherein a surface segment of bracing portion 02 engages with a complementary edge 34 of platform portion 01, so that bracing portion 02 can be folded toward platform portion 01 in a counter-clockwise direction as viewed from the right. This embodiment may also optionally include diverse means of adjusting for variable shelf thickness or platform slope, here illustrated as a series of alternative axes 04' for insertion of ends 18 of bracket 03.

Alternatively, as illustrated, a second type of latching mechanism 35 may be provided for engaging bracing portion 02 in an angular disposition relative to platform portion 01 which, when such latching mechanism is released, allows bracing portion 02 to fold in a clockwise direction toward the bottom surface of platform portion 01 as viewed from the right. Thereby, such an alternative mechanism allows the load 12, herein illustrated as a portable (laptop) computer, to be permanently or semi-permanently attached to platform portion 01 so that the complete assembly of load and device may be folded compactly when not attached to the extant structure. The mechanism 35, provided for engaging elements 01 and 02 in a predetermined angular relationship may be of diverse types of such mechanisms known to industry or, as illustrated, may be a simple sliding mechanism with slots 42 designed to fit over adjacent portions of bracing portion 02. Such a mechanism restricts clockwise rotation in its first position 35 by sliding between platform edge 34 and a continuous axle 44 at axis 24, but allows rotation in its second position 35'. By also including a compression spring within an internal aperture defined by slots 42, such a mechanism can be provided so as to automatically latch when the device is unfolded. By designing such an embodiment with radii of rotation about each axis 04, 24 dimensioned so as to allow the elements 01, 02, 03 to effectively nest with one another, the device can effect a "snap" fit for compact storage.

The aforementioned optional attachment of load 12 to platform portion 01 may be accomplished by an adhesive, screw or other permanent means, or by a mechanical surface fastening system 37 such as adhesive backed hook-and-loop, interengaging mushroom system, or by an interlocking device such as that disclosed in the undersigned's U.S. Pat. No. 5,983,467. Alternatively, this or any embodiment of the subject Folding Cantilevered Support may be integrally manufactured with a load item 12 as a singular compactly folding product with built-in means for temporary attachment to an extant horizontal structure.

CONCLUSION

From the description above, a number of advantages of the subject invention are evident. The device provides a simple, compactly folding, cantilever support which can be readily installed, is structurally secure without the need for mechanical attachment, and is adaptable to many extant conditions such as diverse shelf thickness, edge conditions, and to functional requirements such as vertical or horizontal distance from the extant structure.

In its first preferred embodiment, the invention can be used to support a cookbook or recipe from a wall cabinet or shelf above the working surface of a kitchen, supporting the document at an appropriate angle and height, saving counter space, allowing a cabinet door to close, and isolating the document from inadvertent splash or spills. The device can be used for holding reading material in a library setting or holding reference material at a workstation. It can temporarily display merchandise, instructions or advertisements, samples of merchandise, brochures, other information or products in a sales environment. In contrast to prior art, such a device is particularly advantageous in that it stores compactly, adapts to manifold edge conditions and shelf thicknesses, allows cabinet doors to close, and also includes enhanced features for retaining pages.

In its second preferred embodiment the device provides advantages including compact storage, angular adjustability, easy attachment, and minimal vertical or horizontal intrusion at the extant edge. In the third preferred embodiment, additional advantages include compact storage and allowance for door closure even when the platform portion contains relatively tall items. The fourth preferred embodiment includes the advantages of allowing vertical or horizontal extension before and below the extant structure in a compactly folding device. By including means for attaching or integrating the device with a tool or object such as a laptop computer, the distinct advantage of such a tool which is both portable and effectively self-attaching is afforded.

Although the specification above necessarily includes numerous specificities, these should be construed as illustrating some of the possible embodiments and applications of the invention and not as limiting the scope of the invention. For instance: the device can be manufactured of a wide range of materials including wood, plastics, metal and composites; the platform portion can include special surface treatment such as a frictional surface for a computer mouse, or it can include openings or subdivisions or be specially designed for the containment of particular tools or items; components can be made of a solid structure or of a frame-like matrix; or components of one embodiment may be generally interchanged with those of another. Therefore, the scope of the invention should be determined by the appended claims and their legal equivalents rather than by the specific examples illustrated.

Having completely described the invention and its ramifications above, I hereby claim the following.

The invention claimed is:

1. A portable device for supporting a load in a cantilevered disposition extending from a generally horizontal extant structure, said extant horizontal structure having an edge, a top surface, and a bottom surface, said device comprising:

a platform portion extending in a first direction, said platform portion for holding said load in a cantilevered disposition;

a bracing portion extending in a second direction generally opposite said first direction, said bracing portion having a first bearing segment at its distal end for transferring an upward vertical component of a moment couple, caused by supporting said load in a cantilevered disposition, to said bottom surface at a location remote from said edge; and at least one hanging bracket pivotably attached at a first axis interjacent said platform portion and said bracing portion, said hanging bracket having a second bearing segment at its distal end for transferring a downward vertical component of said moment couple to said top surface of said extant structure at a location adjacent to said edge, said hanging bracket pivoting into a generally compact disposition relative to said platform and bracing portions when said device is not in use;

wherein mounting said second bearing segment of said hanging bracket on said top surface adjacent to said edge and applying said load to said platform portion causes said first bearing segment of said bracing portion to engage with said bottom surface at said location remote from said edge, thereby supporting said load in said cantilevered disposition extending from said extant structure and accommodating a diversity of variable thicknesses between said top surface and said bottom surface of diverse ones of said extant structure.

2. A device in accordance with claim 1, wherein said platform portion and said bracing portion are integral portions of a singular structure.

3. A device in accordance with claim 1, wherein said platform portion and said bracing portion are integral portions of a singular structure, and said hanging bracket is configured so as to pivot to a generally obtuse angular position relative to said platform portion;

so that, when said device is mounted on said extant structure, said platform portion extends in a generally sloped disposition from said structure;

thereby providing an easel-like platform portion.

4. A device in accordance with claim 1, wherein said platform portion, said bracing portion, and said bracket are pivotably attached at said first axis, and said device includes means for stopping the rotation of said bracing portion at a predetermined angular disposition relative to said platform portion;

thereby, in a first configuration for mounting on said structure, providing a generally horizontal platform portion, and in a second configuration with said bracing portion and said bracket pivoted toward said platform portion providing a generally compact configuration when said device is not in use.

5. A device in accordance with claim 1, having said bracing portion pivotably attached to said platform portion at said first axis wherein said bracket is pivotably attached to said bracing portion at a second axis parallel to and remote from said first axis and further wherein said device includes means for stopping rotation and maintaining said bracing portion and said platform portion in relative angular disposition.

6. A device in accordance with claim 1, wherein said bracing portion also includes adjustment means for adjusting the relative slope of said platform portion relative to said extant structure and for accommodating variable thicknesses between said top surface and said bottom surface of diverse ones of said extant horizontal structure.

7. A device in accordance with claim 6 wherein said bracing portion includes said adjustment means for adjusting said relative slope of said platform wherein said means is hingedly attached to said platform portion.

8. A device in accordance with claim 6 wherein said adjustment means includes a plurality of alternative taxes for attaching said bracing portion.

9. A device in accordance with claim 6 wherein said adjustment means includes a series of alternative pivot axes for attaching said hanging bracket to said bracing portion.

10. A device in accordance with claim 6 wherein said adjustment means includes at least one threaded stud having said first bearing segment at its distal end.

11. A device in accordance with claim 1, wherein said device includes means for temporally latching said platform portion to said bracing portion in a predetermined angular relationship.

12. A device in accordance with claim 1 wherein said platform portion includes at least one lateral restraining member comprising a structure projecting in a generally perpendicular direction from at least the distal end of said platform portion.

13. A device in accordance with claim 1, wherein said device also includes a plurality of flexible linear elements attached to said device at only one end of said linear elements, for the purpose of referencing pages of a document loaded on said device.

14. A device in accordance with claim 1, wherein said platform portion includes means for removably attaching said load.

15. A device in accordance with claim 1, wherein said platform portion is an integral component of said load, thereby providing a singular compactly folding entity with integral means for temporary attachment to said extant horizontal structure in said cantilevered disposition.

16. A method of supporting a load in a cantilevered disposition from an extant horizontal structure comprising:

a. providing said extant horizontal structure with an edge, a top surface, and a bottom surface wherein the thickness as measured between said top surface and said bottom surface varies between diverse ones of said structure;

b. providing an interconnected platform portion, bracing portion, and hanging bracket with bearing segment at its distal end, said hanging bracket pivotably attached at a first axis interjacent said platform portion and said bracing portion, said hanging bracket pivoted into a generally compact relationship with said platform portion and said bracing portion;

c. pivoting said distal end of said hanging bracket away from said platform portion and said bracing portion;

d. hanging said bearing segment of said distal end of said hanging bracket from said top surface at a first location adjacent to said edge of said extant structure;

e. pivoting said bracing portion to engage with said bottom surface of said extant horizontal structure at a second location remote from said edge; and f. applying said load to said platform portion so as to cause a moment couple resultant from said load in said cantilevered disposition to react against said extant structure in a downward direction at said first location and in an upward direction at said second location;

thereby supporting said load in said cantilevered disposition from said extant horizontal structure and accommodating said thickness which varies between diverse ones of said structure.

17. A device for supporting a load in an cantilevered position extending from an extant horizontal shelf which comprises:

a structure for receiving said load in said cantilevered disposition, said structure including at least a platform portion extending in a first direction, a bracing portion extending in a second direction generally opposite said first direction, and an axis interjacent said platform and said bracing portions;

and at least one hanging bracket pivotably attached to said structure at said axis and having a generally horizontal bearing segment at its distal end;

so that, when said bearing segment is placed on a top surface of said shelf adjacent to an edge of said shelf and said bracing portion is engaged with a bottom surface of said shelf at a location remote from said edge, said load applied to said platform portion is supported in said cantilevered position and, when said hanging bracket is removed and pivoted toward said structure, said device provides a relatively compact entity.

18. A device in accordance with claim 17 wherein said bracing portion is pivotably attached to said platform, portion and said structure includes means for temporarily maintaining said bracing portion in a fixed angular position relative to said said platform portion.

19. A device in accordance with claim 17 having means for attaching said pivotably attached hanging bracket at said first axis, said means for attaching selected from the group consisting of: a slot through the surface of said structure for receiving an effectively bulbous end of a generally planar said hanging bracket; a slot in said structure containing at least one generally tubular bearing insert for receiving axial segments of said hanging bracket; axial receptors on the lateral edges of said structure for receiving axial segments of said hanging bracket; and a hinge portion attached to said structure for receiving a corresponding hinge segment comprising said axial segments.

20. A device in accordance with claim 17 wherein said device, mounted on said shelf, supports reading and reference materials in a sloped easel-like disposition, said device also comprising means for containing said materials on said shelf, means for restraining the pages of said materials in an open position, and means for distinguishing one or more pages for reference.

* * * * *